US005711684A

United States Patent [19]

Inoue et al.

[11] Patent Number: 5,711,684

[45] Date of Patent: Jan. 27, 1998

[54] CONNECTOR HOUSING LOCKING MECHANISM

[75] Inventors: Kenji Inoue; Hiroyuki Hayashi, both of Yokkaichi, Japan

[73] Assignee: Sumitomo Wiring Systems, Ltd., Japan

[21] Appl. No.: 589,539

[22] Filed: Jan. 22, 1996

[30] Foreign Application Priority Data

Feb. 24, 1995 [JP] Japan ..... 7-061892

[51] Int. Cl.[6] ..... H01R 13/627

[52] U.S. Cl. ..... 439/354; 439/357

[58] Field of Search ..... 439/345, 350–355, 439/357, 358

[56] References Cited

U.S. PATENT DOCUMENTS 4,984,998 1/1991 Duncan et al. ..... 439/352
5,203,715 4/1993 Yamamoto ..... 439/357
5,254,014 10/1993 Yagi et al. ..... 439/353
5,496,190 3/1996 Ittah et al. ..... 439/357

FOREIGN PATENT DOCUMENTS 57-201778 12/1982 Japan .

*Primary Examiner*—Hien Vu
*Attorney, Agent, or Firm*—Banner & Witcoff, Ltd.

[57] ABSTRACT

A female connector housing 11 has a locking arm 30 integrally moulded thereon, the locking arm 30 having a fitting projection 31. A male connector housing 21 has a fitting hole 24 formed on hood member 22 thereof. Two slots 34 are formed on either side of the fitting projection 31 so as to extend along the longitudinal direction of the locking arm 30. The locking arm 30 is thus partitioned into a fitting arm member 35 which includes the fitting projection 31, and two supporting arm members 36 which are formed on both sides thereof. The foot members **36*a* of the supporting arm members 36 are thicker than the foot member 35*a* of the fitting arm member 35, and thus the engagement load of the arm 30 is large, but the projection 35*a*** is nevertheless relatively easy to disengage.

4 Claims, 4 Drawing Sheets

CONNECTOR HOUSING LOCKING MECHANISM

FIELD OF INDUSTRIAL APPLICATION

The present invention relates to a locking mechanism for a connector housing and particularly to a locking mechanism having a locking arm.

BACKGROUND TO THE INVENTION

FIGS. 7 and 8 of this specification show a known version of such a locking mechanism. A connector comprises a female connector housing 1 for insertion of a female terminal fitting, and a male connector housing 2 for insertion of a male terminal fitting. The connector has a configuration whereby a locking arm 4 is moulded integrally on the female connector housing 1 with a foot member 3 as a support. The locking arm 4 is thus in a cantilevered state. A fitting projection 5 is formed on the locking arm 4 and is arranged to fit with a fitting hole 7 formed in a hood member 6 for the male connector housing 2. In order to release the fitting projection 5 from the fitting hole 7, an operating member 8 of the locking arm 4 is pressed down with a finger, thereby moving the locking arm 4, with the foot member 3 as the fulcrum. The fitting projection 5 moves downwards and is thereby released from the fitting hole 7.

In the case of such a mechanism, as shown in FIG. 8, the locking arm 4 lightly presses the fitting projection 5 into fitting hole 7. When the electric wire of the connector, is under tensile loading, the locking arm 4 can bend such that the fitting projection 5 catches at the edge of the opening of the fitting hole 7 and thereby remains in a half-engaged position. In order to prevent this from happening, it has been proposed to make the foot member 3 of the locking arm 4 thicker so as to increase the resilient force thereof.

However, if the foot member 3 of the locking arm 4 is made thicker in this manner, the bending point A of the locking arm 4 is adjusted closer to the operating member 8 than in the conventional case. As a result the length of the arm with respect to the fitting projection 5 is shorter. This feature creates a significant disadvantage in that a larger operating force is now required to release the fitting projection from the fitting hole. Further, because of the shorter arm, the operating member 8 is now required to be pushed down a greater distance than in the conventional case in order to cause that portion of the fitting projection 5 that was in the fitting hole 7 to move out of the hole. Consequently, a problem arises in that fitting and removal operations becoming difficult.

The present invention has been developed taking into consideration the above problems, and aims at providing a locking mechanism for a connector that better prevents a half-engaged state by increasing the resilient force of the locking arm without making the fitting and removal operations difficult.

SUMMARY OF THE INVENTION

According to the invention there is provided a connector housing having a locking mechanism operable to engage another connector housing, the mechanism comprising a resilient cantilevered locking arm of the housing having a fitting member, and engageable in use with a fitted member of the other housing, the locking arm having a foot portion at one end thereof and an operating member at the other end thereof, wherein the locking arm has two longitudinal slots formed therein, whereby the operating member is connected to the foot member by a fitting arm member and a supporting arm member on either side thereof, the fitted member being provided on the fitting arm member, and whereby the fitting arm member is less stiff than the supporting arm members.

Such an arrangement ensures that the increased stiffness of the foot portion does not adversely affect disengagement of the fitting member from the fitted member of the associated connector housing.

Preferably the foot of the fitting arm member is less thick than the feet of the supporting arm members. Such a construction is relatively easily moulded yet ensures that the relative foot stiffness can be controlled. The arm members may have a common external envelope and thus be generally aligned at the point where they emerge from the housing.

In one preferred embodiment the fulcrum of the fitting arm member is further away from the operating member than the respective fulcrums of the supporting arm members. Such an arrangement also ensures that the fitting arm member is less stiff than the supporting arm members by virtue of the longer effective length thereof.

The fitting arm member may lie substantially within the envelope of the supporting arm members, by virtue of having a less stiff foot portion, or may extend outwardly and thereby have a longer lever arm.

Preferably the supporting arm members are identical, and symmetrical. The fitted member is preferably an upstanding projection of the fitting arm member.

BRIEF DESCRIPTION OF DRAWINGS

Other features of the invention will be apparent from the following description of an embodiment of the invention described by way of example only with reference to the accompanying drawings in which.

DESCRIPTION OF PREFERRED EMBODIMENTS

An embodiment of the present invention is explained hereinbelow, with reference to FIGS. 1 to 5.

Figure 1:
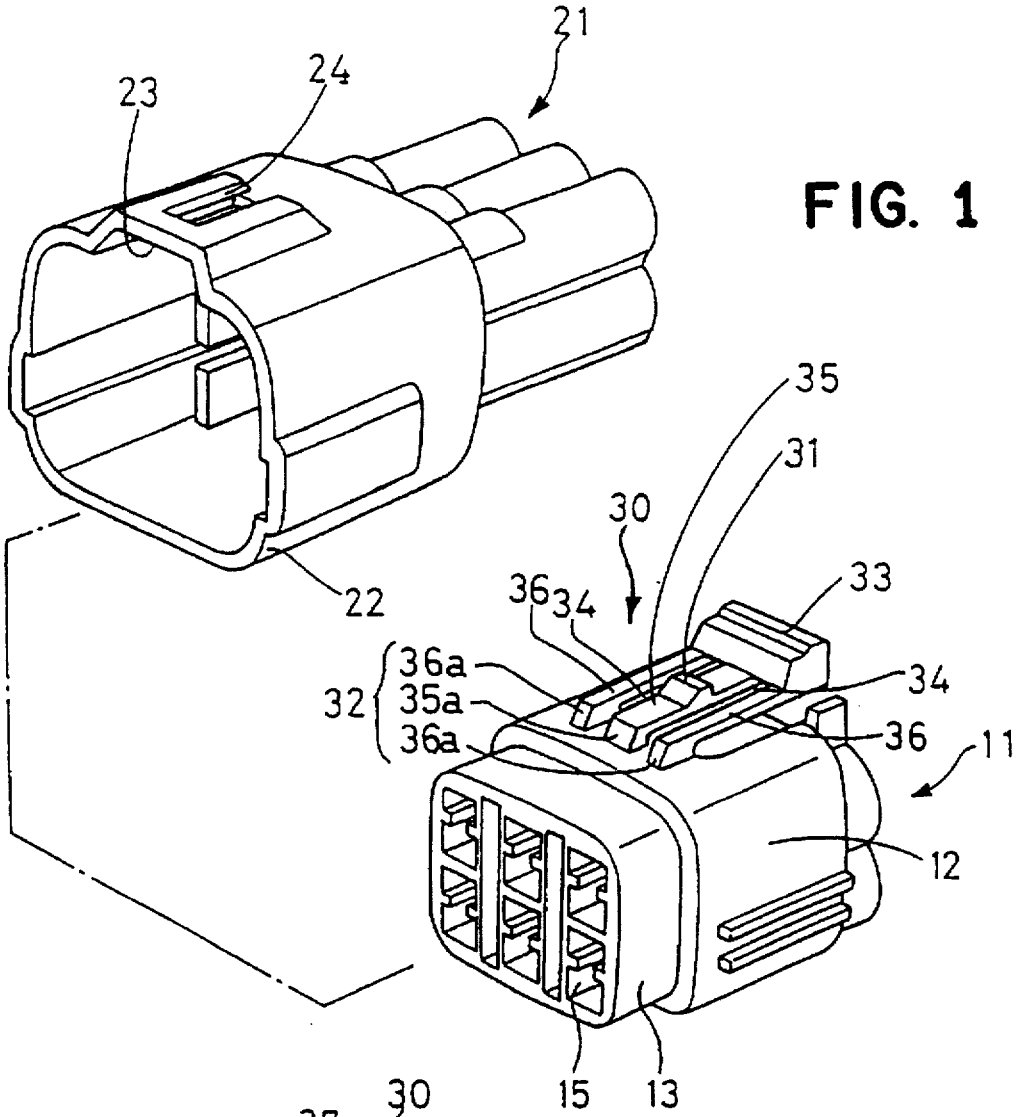
FIG. 1 is an isometric exploded view of one embodiment of the present invention.
Figure 2:
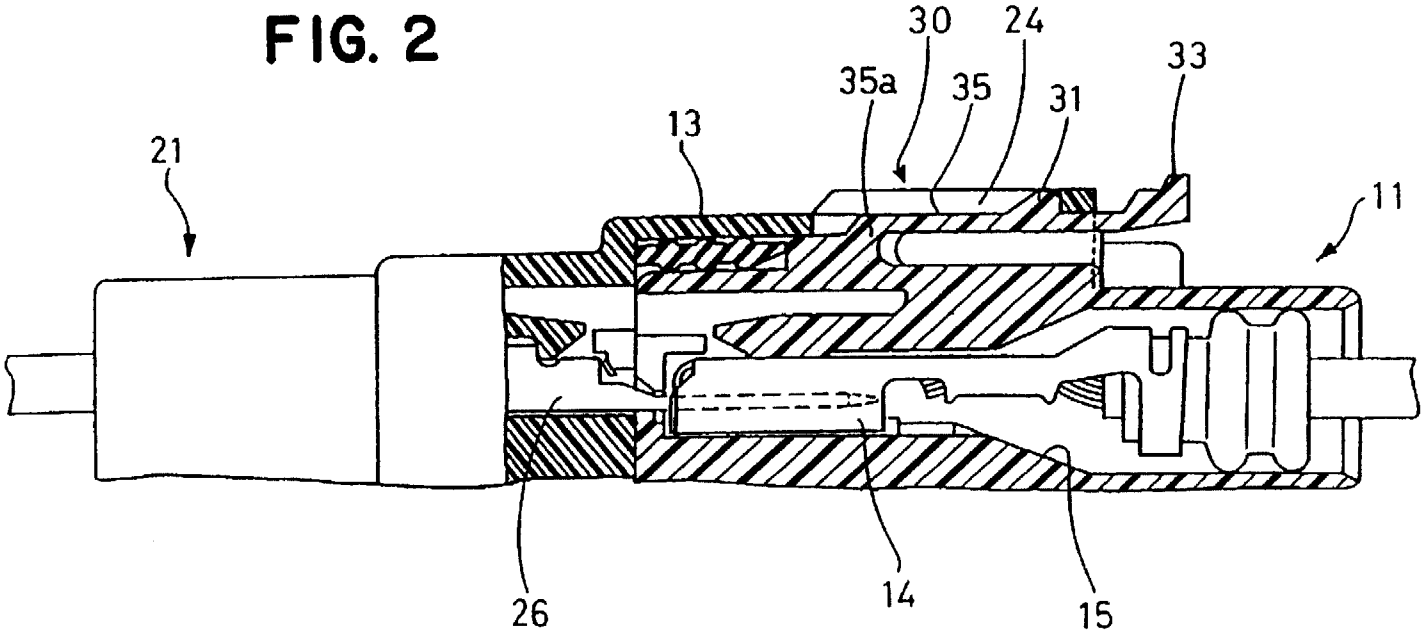
FIG. 2 is a partial longitudinal cross-section through the embodiment of FIG. 1.
Figure 8:
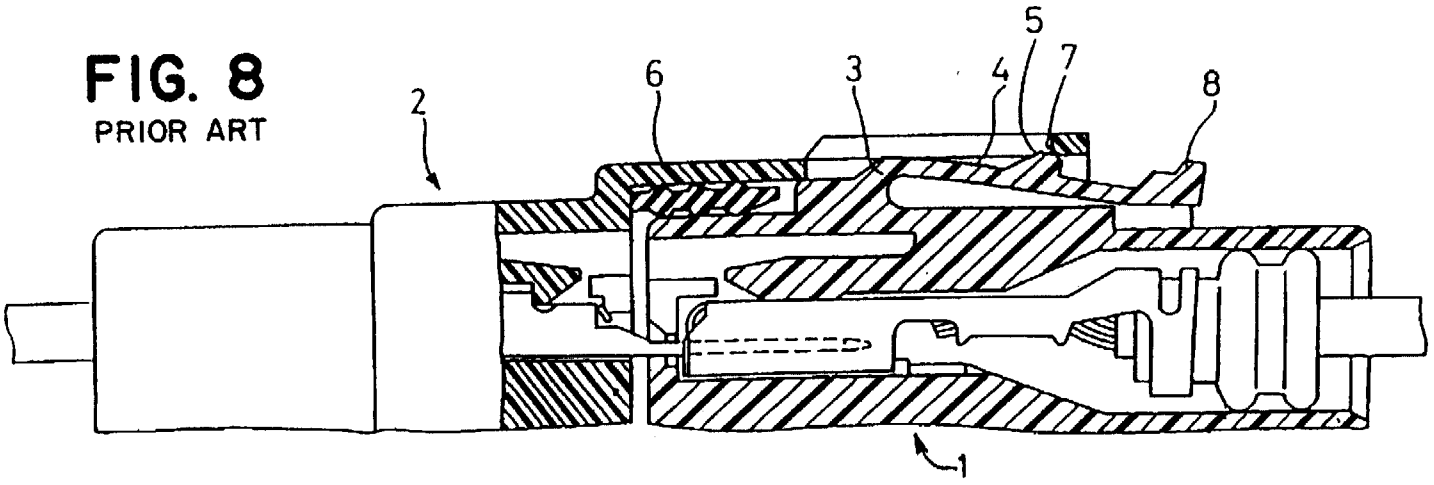
FIG. 8 PRIOR ART
FIG. 8 is a transverse cross-section through a prior art connector assembly.

FIG. 1 shows a female connector housing 11 of, for example, a six terminal waterproof connector, and shows the external structure of a corresponding male connector housing 21. A housing body 12 of the connector housing 11 is a rectangular tubular shape and has rounded edges. Its anterior extremity is made smaller to form a hood receiving member 13. As shown in FIGS. 1 and 2, the interior of the housing body 12 has six cavities 15 for the insertion of female terminal fittings 14, the cavities 15 being formed on two levels, an upper level and a lower level.

The male connector housing 21 has a hood member 22 that fits with the exterior of the hood receiving member 13. Male terminal fittings 26 project into the interior of the hood member 22. When the hood member 22 is fitted with the hood receiving member 13, the male terminal fittings 26 and the female terminal fittings 14 are connected.

In order to provide a locking mechanism for retaining the connector assembly, a locking arm 30 is moulded in a unified manner on the housing body 12 of the connector housing 11. The hood member 22 of the male connector housing 21 has an arm receiving member 23 for receiving the locking arm 30 as illustrated. A fitting hole 24, corresponding to a fitting member, is formed on the arm receiving member 23, and a fitting projection 31, corresponding to a fitted member, is formed on the locking arm 30 so as to project therefrom and to fit into the fitting hole 24.

As shown in FIG. 1, the locking arm 30 is integrally moulded on the female connector housing 11 so as to be cantilevered via a foot member 32. Its free end has an operating member 33 formed so as to project outwards. Moreover, the locking arm 30 has two slots 34 extending in the longitudinal direction thereof. The slots 34 are formed in a position whereby they are on either side of the fitting projection 31. Consequently, the locking arm 30 is partitioned, and comprises a fitting arm member 35 which includes the fitting projection 31, and two supporting arm members 36 which are formed on either side and which do not include the fitting projection 31. In the present embodiment, the extreme inner end of a foot member **35*a* of the fitting arm member 35 and the extreme inner ends of foot members 36*a* of the supporting arm members 36 are in the same lateral position. The dimension B (FIG. 4) of the thickness of the foot member 36*a* is greater than the dimension A (FIG. 3) of the thickness of the foot member 35*a*. The three arm members 35 and 36 connect uniformly with the operating member 33. Consequently, when the operating member 33 is pushed down, the three arm members 35 and 36 bend elastically, with the respective foot members 35*a* and 36*a*** defining the axes of movement.

Figure 5:
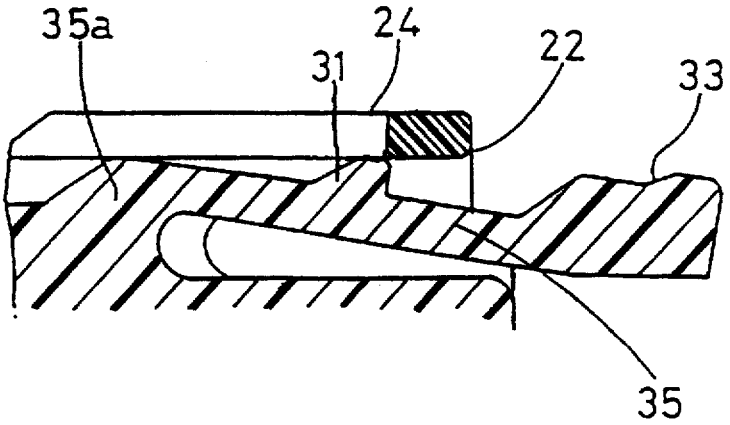
FIG. 5 is an enlarged cross-section illustrating the half-engaged position.
Figure 7:
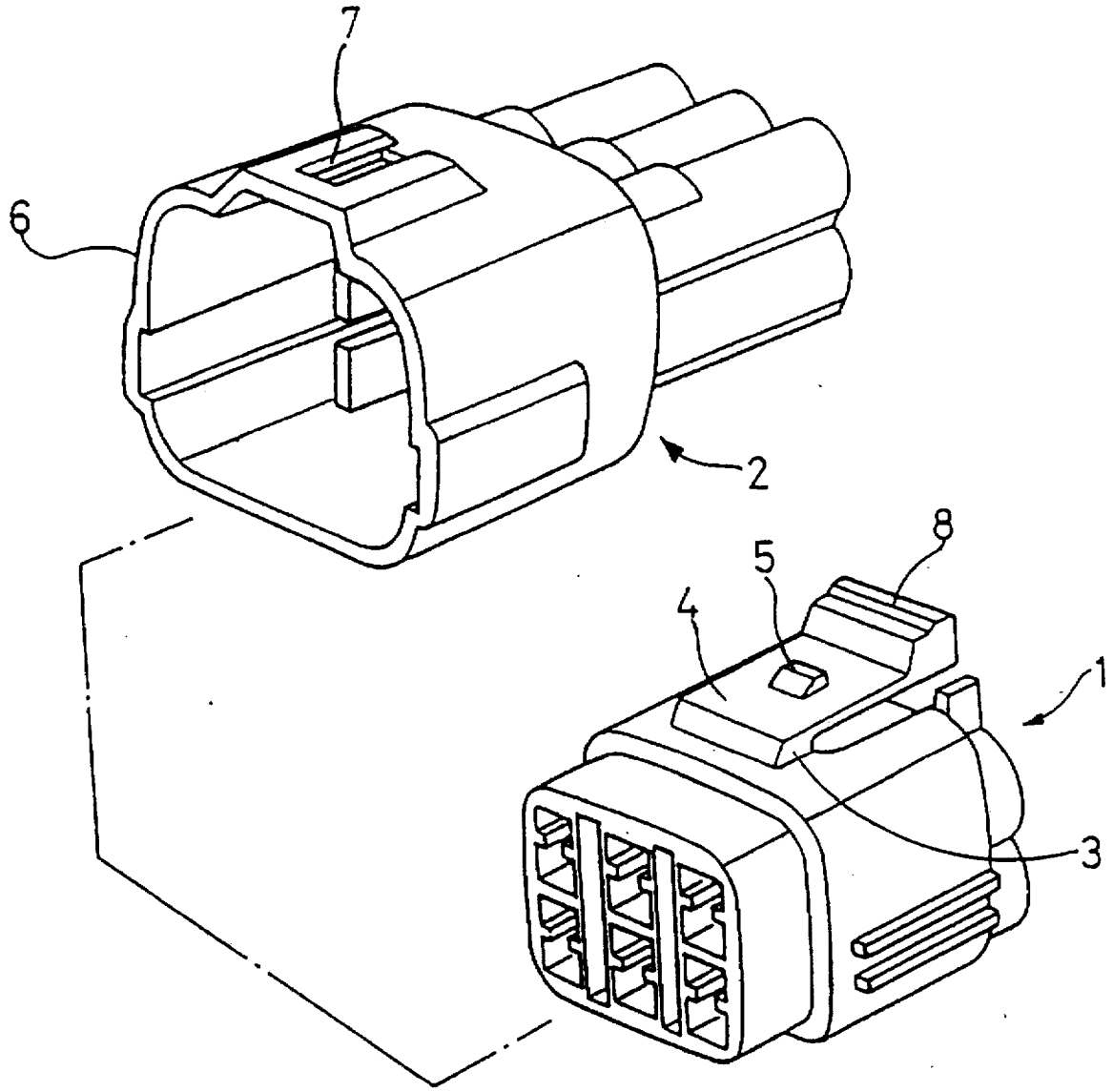
FIG. 7 PRIOR ART
FIG. 7 is an isometric view showing the prior art locking mechanism of a connector.

In order to couple the connectors described above, the hood member 22 of the male connector housing 21 is fitted with the hood receiving member 13 of the female connector housing 11 and the locking arm 30 is inserted into the arm receiving member 23. Once this is done, the fitting projection 31 of the locking arm 30 makes contact with the anterior extremity of the hood member 22. The locking arm 30 bends downwardly, with the foot members 32 as the fulcrum, by pushing the operating member 33 downwards. At this point, since the hood member 22 makes contact with the fitting projection 31, the force applies only to the fitting arm member 35. However, the fitting arm member 35 is connected via the operating member 33 to the two supporting arm members 36 provided on either side thereof. As a result, the three arm members 35 and 36 elastically bend simultaneously with the respective foot members **35*a* and 36*a* as fulcrums and are pushed down in a unified manner. Consequently, a strong resilient force is ensured, and, as shown in FIG. 5, the fitting projection 31 reaches the fitting hole 24, and enters under a strong resilient force. The strong resilient force thus serves as an insertion force for the female connector housing 11 and this results in a firm connection between both the connectors 11 and 21. As shown in FIG. 5, the so-called half-engaged state, whereby the fitting projection 31 catches the edge of the fitting hole 24** is prevented.

In a test, when both connectors 11 and 21 are connected, the locking arm 30 is placed under load such that a force is applied in the removal direction of the connectors 11 and 21 by pulling on the wires. In the prior art case a pulling force of 10 N resulted in a half-engaged state being obtained. However in the inventive embodiment, a pulling force of 40 N did not result in movement of the connectors to the half-engaged position.

Figure 3:
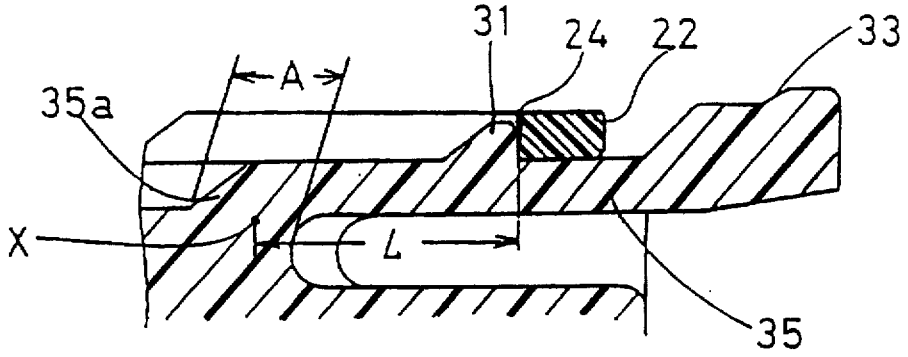
FIG. 3 is an enlarged cross-section through the fitting arm member of the embodiment of FIG. 1.
Figure 4:
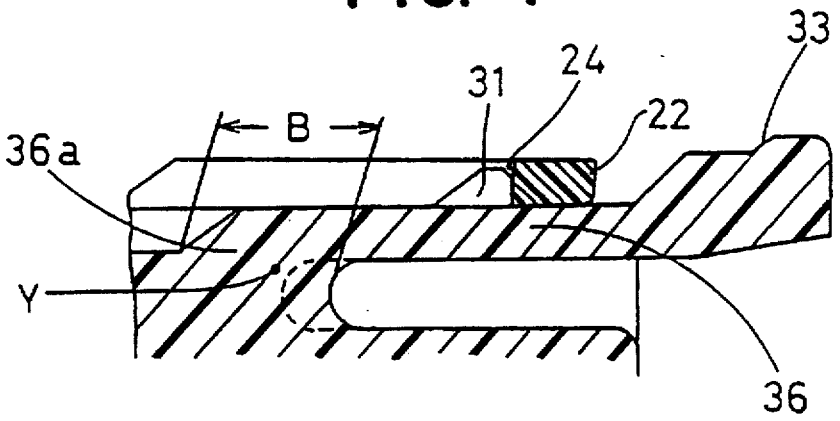
FIG. 4 is an enlarged cross-section through the supporting arm member of the embodiment of FIG. 1.

In order to release the connectors which are in a connected state, the operating member 33 of the locking arm 30 is bent down. The female connector housing 11 is removed from the hood member 22 of the male connector housing 21. When the operating member 33 is pushed down, the three arm members 35 and 36 bend with the respective foot members **35*a* and 36*a* as fulcrums and change shape in a unified manner. Note that, in the present embodiment, although the anterior extremity of the foot member 35*a* of the fitting arm member 35 is in the same location as the anterior extremities of the foot members 36*a* of the supporting arm members 36, the dimension A of the thickness of the foot member 35*a* is less (FIG. 3). As a result, as shown in FIGS. 3 and 4, the movement fulcrum X of the fitting arm 35 is more to the left as compared to the movement fulcrum Y of the supporting arm members 36. Consequently, the arm length L from the fulcrum X to the fitting projection 31 is relatively long. This means that a downward stroke applied to the operating member 33 will result in a deeper dropping of the fitting projection 31 compared to the case where the foot member is thick. As described earlier, a strong resilient force is thus achieved, and superior removability results without requiring an increase in the downward force to be applied to the operating member 33**.

According to the present embodiment, as described above, the dimension B of the thickness of the foot member **36*a* of the supporting arm members 36 is arranged to be large to increase the resilient force of the locking arm 30. However, since the foot member 35*a* of the fitting arm member 35 is thinner, the fulcrum X of the fitting arm member 35 is not shifted towards the operating member 33. As a result, the arm length up to the fitting projection 31 remains long. This construction prevents the relatively small dropping of the fitting projection 31 to the half-engaged position because of the pushing force of the locking arm 30. Despite the increased resilient force of the locking arm the fitting and removal operations remain simple. Consequently, an effect is achieved that the occurrence of a half-engaged position is reliably prevented without compromising on operability. Moreover, and particularly in the present embodiment, since the locations of the anterior extremities of the foot member 35*a* of the fitting arm member 35 and of the foot members 36*a* of the supporting arm members 36 are the same as in the conventional case, and only the thicknesses of the foot members 35*a* and 36*a*** are made to vary, the effects described above are achieved with only a minimal change in the conventional structure.

The present invention is not limited to the embodiment described above with the aid of diagrams. For example, the possibilities described below also lie within the technical range of the present invention. Moreover, the present invention may be embodied in various ways other than those described below without deviating from the scope thereof.

Figure 6:
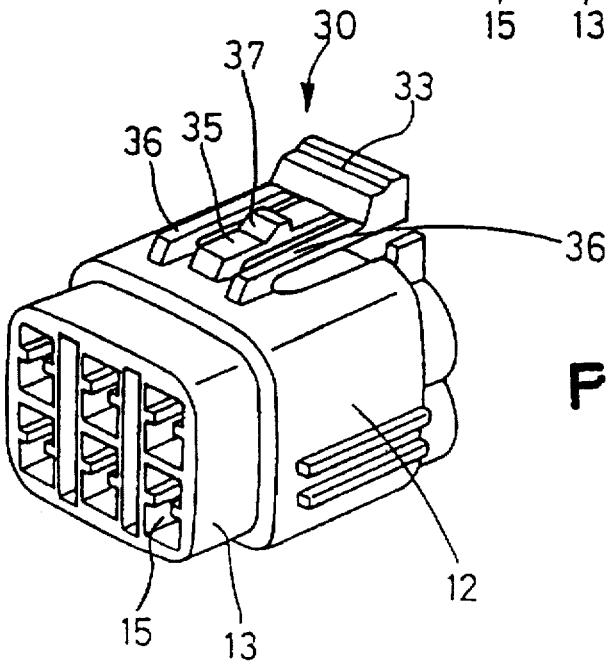
FIG. 6 is an isometric view of a female connector housing showing an alternative embodiment.

(1) In the first embodiment, it was arranged so that the extreme anterior end of the foot member **35*a* of the fitting arm member 35 and the extreme anterior ends of the foot members 36*a* of the supporting arm members 36 are in the same position. However, as shown for example in FIG. 6, the configuration may equally be arranged so that the extreme anterior end of the foot member 35*a* of the fitting arm member 35 is located towards the operating member 33 compared to the foot member 36*a* of the supporting arm member 36. In this case as well, if the thickness of the foot members 36***a* of the supporting arm members 36 is arranged to be greater than the thickness of the foot member 35*a* of the fitting arm member 35, the same superior effects as compared to the conventional configuration are achieved as in the previous embodiment. Further, although not shown in a diagram, the exact opposite of the arrangement shown in FIG. 6 may be effected whereby the extreme anterior end of the foot member 35*a* of the fitting arm member 35 is located further away from the operating member 33 compared to the foot members 36*a* of the supporting arm members 36. In such a case, there is no need to provide a difference between the thickness of the foot members 35*a* and 36*a* as provided in the previous embodiments.

(2) Although in the previous embodiment the fitting projection 31 was provided as the fitted member, the configuration may equally be arranged so that a fitting hole is provided as the fitted member and a fitting projection is provided as a fitting member on the male connector housing 21.

We claim:

1. An electrical connector housing having a locking mechanism operable to engage another electrical connector housing, the locking mechanism comprising a resilient cantilevered locking arm of the housing, said locking arm having one of a fitting projection or fitting hole, said one fitting projection or fitting hole of said locking arm being engageable in the other of a fitting projection or fitting hole of said another housing to releasably secure the connector housings together, the locking arm having a foot portion at one end thereof to connect the locking arm to the housing and an operating member at the other end thereof, wherein the locking arm has two longitudinal slots formed therein so that the operating member is connected to the foot portion by a fitting arm member and a supporting arm member on each side of said fitting arm member, said one fitting projection or fitting hole of the locking arm being provided on the fitting arm member, the foot portion including a separate foot for supporting each of the fitting arm member and the supporting arm members, and wherein the foot supporting said fitting arm member is smaller than each foot supporting said supporting arm members so that the fitting arm member is less stiff than each of the supporting arm members.

2. A housing according to claim 1 wherein the fitting arm member and supporting arm members have respective fulcrums, the fulcrum of the fitting arm member being further away from the operating member than the respective fulcrums of the supporting arm members.

3. A housing according to claim 1 wherein said supporting arm members are substantially identical.

4. An electrical connector housing having a locking mechanism operable to engage another electrical connector housing, the locking mechanism comprising a resilient cantilevered locking arm of the housing, said locking arm having one of a fitting projection or fitting hole, said one fitting projection or fitting hole being engageable in the other of a fitting projection or fitting hole of said another housing to releasably secure the connector housings together, the locking arm having a foot portion at one end thereof to connect the locking arm to the housing and an operating member at the other end thereof, wherein the locking arm has two longitudinal slots formed therein so that the operating member is connected to the foot portion by a fitting arm member and a supporting arm member on each side of said fitting arm member, said one fitting projection or fitting hole of the locking arm being provided on the fitting arm member, and the fitting arm member and the supporting arm members each being pivotally supported for movement about a fulcrum at the foot portion, wherein the fulcrum of the fitting arm member is spaced farther away from the operating member than the respective fulcrums of the supporting arm members so that the fitting arm member is less stiff than each of the supporting arm members.

* * * * *